US006786155B2

(12) United States Patent
Bhambra

(10) Patent No.: US 6,786,155 B2
(45) Date of Patent: Sep. 7, 2004

(54) DIMENSIONALLY STABLE PAPER SUBSTRATE FOR A PRECURSOR TO AN IMAGED MEMBER

(75) Inventor: Harjit Singh Bhambra, Delta (CA)

(73) Assignee: Kodak Polychrome Graphics LLC, Norwalk, CT (US)

( * ) Notice: Subject to any disclaimer, the term of this patent is extended or adjusted under 35 U.S.C. 154(b) by 41 days.

(21) Appl. No.: 10/134,204

(22) Filed: Apr. 26, 2002

(65) Prior Publication Data

US 2003/0200884 A1 Oct. 30, 2003

(51) Int. Cl.[7] ..... B41M 1/12
(52) U.S. Cl. ..... 101/460; 428/211; 428/537.5
(58) Field of Search ..... 101/453, 460, 101/462, 463.1, 467; 428/196, 211, 537.5

(56) References Cited

U.S. PATENT DOCUMENTS 4,028,111 A * 6/1977 Iwasaki et al. ..... 430/166
4,491,502 A * 1/1985 Martin, Jr. ..... 162/146

FOREIGN PATENT DOCUMENTS

WO 99/44838 * 9/1999

* cited by examiner

*Primary Examiner*—Stephen R. Funk
(74) *Attorney, Agent, or Firm*—Faegre & Benson, LLP

(57) ABSTRACT

The invention comprises a precursor to an imaged member comprising a dimensionally stable substrate including an imagable coating, on a surface thereon, wherein the non-coated dimensionally stable substrate comprises dimensionally stable paper comprising at least one of the following characteristics: (i) an elastic yield such that the tensile force required to exceed the elastic yield is greater than 60 $Nmm^{-2}$; (ii) a percentage elongation of the paper under a tensile load or strain at the elastic yield point smaller than 1%; and (iii) a Young's Modulus under tensile load greater than 7 GPa. The invention further extends to a method of manufacturing an imaged member from an imaged member precursor of the invention.

23 Claims, No Drawings

DIMENSIONALLY STABLE PAPER SUBSTRATE FOR A PRECURSOR TO AN IMAGED MEMBER

BACKGROUND OF THE INVENTION

1. Field of the Invention

This invention relates to imagable and imaged members. In particular, but not exclusively, this invention relates to printing form, electronic part and mask precursors and imaged printing forms, electronic parts and masks.

2. Background Information

Imaged articles, such as printing forms, electronic parts and masks, conventionally comprise a substrate onto which has been coated a film forming radiation sensitive composition, the composition having been image-wise exposed to radiation of suitable wavelength, and developed to produce the imaged member.

A common form of printing plate used in the printing industry is the lithographic printing forms. Many lithographic printing plates are imaged within imagesetters. In the manufacture of such lithographic plates, rolls or sheets of flexible material are generally fed into the image setting apparatus and digitally imaged within the imagesetter before being forwarded to prepress processing and onto a printing press. Imagesetters generally include one or more rollers or angular components around which the flexible precursor must bend during imaging. Thus, the substrate of the precursor must be flexible enough to allow passage over rollers and angular components. As such, typical substrates used for lithographic printing forms include flexible polyester sheets and paper sheets. The inherent flexibility of these materials allows the precursor to travel round rollers and angular components with relatively little damage to the structure of the precursor and imaged precursor.

However, problems arise once the imaged precursor has traveled through the imagesetter and undergoes prepress processing and clamping to the press cylinders of the printing press. In order for efficient printing to be effected, the imaged member must be securely clamped to the printing press, and pulled taut such that there are no inconsistencies in the relief of the plate on the press. Generally, such plates are pulled taut by the practice of clamping both the leading and trailing edge of the plate to the print cylinder. The practice of clamping and tightening of the imaged member can easily stretch flexible substrates such as polyester and paper when mechanically stressed. Stretching of the substrate induces stretching of the imaged coating on the substrate, which distorts any image printed from that particular plate. Furthermore, there is a danger that, with particularly flexible substrates such as paper, that tightening of the imaged member on the printing press will lead to tearing of the substrate with a subsequent loss of image.

Thus, the inherent flexibility of such plates whilst advantageous for the process of imaging in a imagesetter, also confers inherent dimensionally instability on those substrates, which can be disadvantageous when mounting the substrate on a printing cylinder.

Other more dimensionally stable forms of substrate can be used, such as aluminum plates, but their inherent inflexibility considerably increases the difficulty of the aluminum printing forms being passed through imagesetters. As imagesetters are used by many printing operatives around the globe, the cost of converting from using film setting equipment to equipment which can utilize inflexible aluminum plates can be financially prohibitive.

Other imaged members such as flexographic printing plates and printed circuit boards are commonly made from thick sheets of flexible plastic substrate. The thickness of the sheet is used to effect sufficient dimensional stability to the substrate against stresses encountered during use. The need for thick substrates, is relatively expensive and there is a desire in the industry to reduce substrate thickness whilst maintaining dimensional stability.

For flexographic plates in particular, historically these imaged members have been imaged by using film as a masking medium. The need for separate masking medium is relatively labor intensive and enhances the cost of producing such flexographic plates. The flexographic printing plate industry has consequently been looking for ways to reduce costs and labor intensity of producing such plates. One method of reducing costs and labor, would be to adopt the digital imaging using readily available film setting equipment, which eliminates the need for masking medium and its associated costs. However, the thickness and relative inflexibility of the substrates used in flexographic printing, compared to the flexible substrates used in lithographic printing, prevents their use in conventional imagesetting equipment.

Many attempts have been made to improve the dimensional stability of flexible substrates which allow the substrate to pass through an imagesetter but which after imaging is dimensionally stable enough to endure the mechanical stress of being tightened over a printing cylinder or printing surface. In particular, many flexible substrates are laminated with a dimensionally stable support such as an aluminum surface or dimensionally stable plastic surface, which laminated support is generally of a very thin construction in order that the flexible support may pass through an imagesetter. Examples of laminated flexible supports include those disclosed in U.S. Pat. No. 4,092,925 (Fromson), U.S. Pat. No. 2,048,964 (Osbourne), EP 690349 A1 (Dupont), U.S. Pat. No. 4,032,684 (Dunnington et el), WO 93/10979 (Aloisi), U.S. Pat. No. 3,979,212 (Peters et el), EP 644064 A (Agfa), EP 807534 A (Agfa) and WO 98/53371 (Identity Group Inc.). In each of these documents, aluminum or plastic sheeting is laminated to an imaged or imagable member in order to increase its dimensional stability when mounted on a printing press. The cost of the lamination materials, laminating equipment and processing can be relatively expensive, and time consuming.

JP 3073392 discloses a lithographic printing plate comprising a paper base in which an electron beam hardenable resin is impregnated, and to which is coated an electron beam hardenable resin layer. The impregnated paper and resin layer are then irradiated using an electron beam in order to harden the resins, in order to increase the stability of the printing plates. Again, the cost of providing impregnated resin and a further electron beam hardenable resin coating is relatively expensive, and time consuming to perform.

There is therefore a need in the lithographic printing, flexographic printing and printed circuit board industries for a substrate which is imagesetter compatible in its flexibility, but which after imaging is dimensionally stable enough to endure the mechanical stress of being tightened over a printing cylinder or printing surface, in the case of circuit boards, and which does not involve expensive and time consuming treatment in order to render the substrate dimensionally stable.

It is therefore an aim of preferred embodiments of the present invention to overcome or mitigate at least one of the problems of the prior art, or other problems, whether expressly described hereinabove or not.

SUMMARY OF THE INVENTION

According to a first aspect of the present invention there is provided a precursor to an imaged member comprising a dimensionally stable substrate including an imagable coating on a surface thereof, wherein the uncoated dimensionally stable substrate comprises dimensionally stable paper comprising at least one of the following characteristics:

(i) an elastic yield such that the tensile force required to exceed the elastic yield is greater than 60 $Nmm^{-2}$;

(ii) a percentage elongation of the paper under a tensile load or strain at the elastic yield point less than 1%; and (iii) a Young's Modulus under tensile load greater than 7 GPa.

By "elastic yield" we mean the limit to which the substrate can be strained with a load and still return to its original length on unloading.

By dimensional stability we mean the structural capability of the substrate to resist damage from mechanical stress. Resistance may be against stretching, breaking, tearing, distortion, indentation, warping, buckling or contraction caused by mechanical stress, for example.

In the case of an anisotropic paper the values of (i), (ii) and (iii) are the minimum values of the paper in any one direction.

The dimensionally stable paper suitably comprises characteristics (i) and (ii); (ii) and (iii); or (i) and (iii), but preferably comprises all three characteristics (i), (ii) and (iii).

DETAILED DESCRIPTION OF THE INVENTION

Preferably the tensile force required to exceed the inelastic yield point of the paper is greater than 75 $Nmm^{-2}$, more preferably greater than 90 $Nmm^{-2}$ and most preferably greater than 120 $Nmm^{-2}$.

Preferably the percentage elongation of the paper under tensile load or strain at the inelastic yield point is less than 0.75%, more preferably less than 0.5% and most preferably less than 0.25%.

Preferably the Young's Modulus of the paper under tensile load is greater than 10 GPa, more preferably greater than 12 GPa, and most preferably greater than 14 GPa.

The paper may comprise natural or synthetic fibers which may comprise cotton, cellulosic material, plastics material such as polyester, or polyethylene fibers, for example, or mixtures thereof.

The paper may comprise strengthening fibers. Strengthening fibers are in addition to the regular fibers of the paper, and effect improved mechanical properties of the paper, such as effecting an increase in the Young's Modulus, or elastic yield of the paper. The strengthening fibers will be selected according to the type of regular fiber already present in the paper but may be fibers such as silicon fibers, cellulose fibers, aliphatic or aromatic polyamide fibers, polypropylene fibers or graphite fibers, for example, in addition to the regular fibers of the paper material.

Alternatively or additionally the paper may comprise sintered fibers which form inter-fiber bonds.

The sintered fibers may be regular fibers of the paper which are sintered to improve the dimensional stability of the paper by a sintering process, preferably a process employed whilst under applied pressure at an elevated temperature, below the degradation point of the fibers.

The sintering process is preferably such that the mechanical properties of the paper are improved due to inter-fiber interactions and/or bonding.

The sintered fibers may be prepared by the addition of separate fibers to the regular fibers of the paper, which are then sintered to form inter-fiber bonds or interactions with the regular fibers and/or other sintered fibers.

Sintering may be enhanced by the addition or presence of a cross-linking agent.

Fibers suitable for undergoing a sintering process include those formed from PTFE, polypropylene, and aliphatic or aromatic polyamides, for example.

Suitably the precursor is a precursor to a printing form, a precursor to an electronic part or a precursor to a mask.

When the precursor is a precursor to a printing form it may be a precursor to a lithographic printing form, or to a flexographic printing form.

When the precursor is a precursor to an electronic part it is suitably a precursor to a printed circuit board (PCB).

The coating may comprise a positive working composition or a negative working composition.

The imagable coating may be a diazo coating, photopolymer coating, silver halide coating, electrophotographic coating, thermally sensitive coating, ablatable coating or a coating suitable for waterless printing. Each of these coatings are well known to those skilled in the art.

The coating is preferably such that it is image-wise exposable by radiation. Preferred coatings may be such that they are image-wise insolubilized by radiation or image-wise solubilized by radiation.

The radiation itself may be emitted image-wise in order to effect image-wise exposure of the precursor.

For example the radiation may be emitted image-wise by a laser.

The radiation may alternatively be flood emitted through a screen, the screen comprising image and non-image areas, wherein either the image or non-image areas are transparent to the radiation emitted.

Alternatively the image-wise exposure of the precursor may be effected indirectly by exposure to radiation transmitted or reflected from the background areas of a graphic original located in contact with the precursor.

Suitably, in methods using a precursor of the invention the radiation used to expose the precursor is visible and/or UV radiation. Preferably, it is of wavelength entirely or predominantly exceeding 200 nm, more preferably entirely or predominantly exceeding 300 nm. Preferably it is of wavelength entirely or predominantly below 800 nm, more preferably entirely or predominantly below 450 nm. Thus a preferred wavelength of the radiation used to expose the precursor is 300 nm to 450 nm.

Preferably the sensitivity of the photosensitive composition coated on the precursor is at a practicable level, but is suitably no more that 400 $mJcm^{-1}$, preferably no more that 300 $mJcm^{-1}$.

The radiation may be delivered by any suitable light source such as a xenon lamp, a metallohalogen lamp, a tungsten bulb or a laser, for example an excimer laser.

Preferably the visible and/or UV sensitive coating comprises a diazide moiety.

The diazide moieties preferably comprise diazo groups, $=N_2$, conjugated to carbonyl groups, preferably via an aromatic or heteroaromatic ring. In such moieties a carbonyl group is preferably bonded to the aromatic or heteroaromatic ring at an adjacent ring position to the diazo group. Preferred moieties are o-benzoquinonediazide (BQD) moieties (often referred to as o-quinonediazides) and o-naphthoquinonediazide (NQD); moieties.

A BQD moiety may, for example, comprise a 1,4- or, preferably 1,2-benzoquinonediazide moiety.

An NQD moiety may, for example, comprise a 1,4-, 2,1- or, most preferably, a 1,2-naphthoquinone diazide moiety.

Generally, NQD moieties are preferred to BQD moieties in the practice of the invention.

Most preferred in the practice of the present invention is a 1,2-naphthoquinonediazide moiety.

The diazide may be present as a simple compound admixed into the composition or, as is preferred, as a moiety which is covalently bonded as a functional group to a polymer of the composition.

Preferred diazide compounds are sulfonyl compounds in which the group —$SO_2$— is bonded to an aromatic ring, suitably to the 5- or, especially, to the 4-position of a naphthyl ring. Its other chemical bond may be to a polymer chain—the functionalization approach—or may be to a ballast moiety such as a hydroxylbenzophenone group, especially 2,4-dihydroxyphenone—the admixture approach.

Examples of preferred naphthoquinone diazide moieties which may be used in the photosensitive composition are disclosed in a variety of publications such as U.S. Pat. Nos. 2,766,118; 2,767,092; 2,772,972; 2,859,112; 2,907,665; 3,046,110; 3,046,111; 3,046,115; 3,046,118; 3,046,119; 3,046,120; 3,046,121; 3,046,122; 3,036,123; 3,061,430; 3,102,809; 3,105,465; 3,635,709; and 3,647,443. Among these, preferred are o-naphthoquinonediazido sulfonates or o-naphthoquinonediazido carboxylates of aromatic hydroxyl compounds; o-naphthoquinone diazido sulfonic acid amides or o-naphthoquinonediazido carboxylic acid amides of aromatic amine compounds, for instance, esters of naphthoquinone-1,2-diazido sulfonic acid with polyhydroxyphenyl; esters of naphthoquinone-1,2-diazido-4-sulfonic acid or naphthoquinone-1,2-diazido-5-sulfonic acid with pyrogallol/acetone resins; esters of naphthoquinone-1,2-diazidosulfonic acid with novolac-type phenol/formaldehyde resins or novolac-type cresol/formaldehyde resins; amides of poly(p-aminostyrene) and naphthoquinone-1,2-diazido-4-sulfonic acid or naphthoquinone-1,2-diazido-5-sulfonic acid; esters of poly (p-hydroxystyrene) and naphthoquinone-1,2-diazido-4-sulfonic acid or naphthoquinone-1,2-diazido-5-sulfonic acid; and amides of polymeric amines with naphthoquinone-1,2-diazido-4-sulfonic acid. The term "ester" used herein also includes partial esters. Preferred compositions contain naphthoquinone diazide moieties of the following structure:

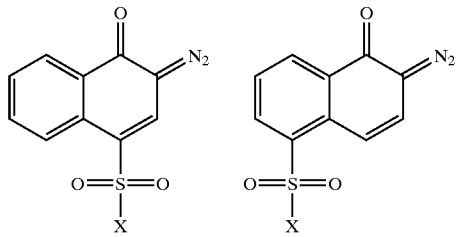

2,1,4-NQD 2,1,5-NQD where X is preferably a polymer; but could be a ballast moiety, for example a dihydroxybenzophenone group.

The composition may comprise a polymer selected from the group consisting of polyurethanes, phenolic resins, poly (hydroxystyrenes) and polyacrylic resins, as homopolymers, copolymers or terpolymers. Preferably the polymeric composition includes a polymer having hydroxyl groups. Preferably the composition contains at least 20%, more preferably at least 50%, most preferably at least 70%, of such a resin, or of such resins in total, by weight on total weight of the composition.

Particularly useful phenolic resins for compositions useful in this invention in this invention are condensation reaction products between appropriate phenols, for example phenol itself, C-alkyl substituted phenols (including cresols, xylenols, p-tert-butyl-phenol, p-phenylphenol and nonyl phenols), diphenols e.g. bisphenol-A (2,2-bis(4-hydroxyphenyl)propane), and appropriate aldehydes, for example formaldehyde, chloral, acetaldehyde and furfuraldehyde. Dependent on the preparation route for the condensation a range of phenolic materials with varying structures and properties can be formed. Particularly useful in this invention are novolak resins, resole resins and novolak/resole resin mixtures. Most preferred are novolak resins. The type of catalyst and the molar ratio of the reactants used in the preparation of phenolic resins determines their molecular structure and therefore the physical properties of the resin. An aldehyde:phenol ratio between 0.5:1 and 1:1, preferably 0.5:1 to 0.8:1 and an acid catalyst is used to prepare novolak resins. Examples of suitable novolak resins have the following general structure

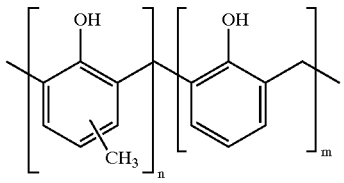

where the ratio of n:m is in the range of 1:20 to 20:1, preferably 3:1 to 1:3. In one preferred embodiment n=m. However, in certain embodiments n or m may be zero. Novolak resins suitable for use have a molecular weight in the range of about 500–20,000, preferably in the range of about 1000–15,000, more preferably about 2500–10,000.

Other polymers suitable for inclusion in the composition, notably in admixture with a phenolic, preferably novolak, resin, include: poly-4-hydroxystyrene; copolymers of 4-hydroxystyrene, for example with 3-methyl-4-hydroxystyrene or 4-methoxystyrene; copolymers of (meth) acrylic acid, for example with styrene; copolymers of maleiimide, for example with styrene; hydroxy or carboxy functionalized celluloses; dialkylmaleiimide esters; copolymers of maleic anhydride, for example with styrene; and partially hydrolysed polymers of maleic anhydride.

The Tg of typical compositions containing novolak resins is about 90–110° C. depending on the novolak resins selected, on their amount by weight in the composition, and on other components of the composition.

The composition may be such that it is imagewise exposable by heat, preferably image-wise insolubilized or solubilized by heat. In broad terms there are three ways in which heat can be imagewise delivered to the composition, in use. These are:

Direct heat, by which we mean the direct delivery of heat by a heated body, by conduction. For example the composition may be contacted by a heat stylus; or the reverse face of the substrate onto which the composition has been coated may be contacted by a heated body. A heated body may be a heat stylus.

The use of incident electromagnetic radiation to expose the composition, the electromagnetic radiation being converted to heat, either directly or by a chemical reaction undergone by a component of the composition. The electromagnetic radiation could for example be infra-red, or UV or visible radiation, depending on the composition. Preferably it is infra-red.

The use of charged-particle radiation, for example electron beam radiation. Clearly, at the fundamental level the charged-particle mode and the electromagnetic mode are convergent; but the distinction is clear at the practical level.

In patternwise exposing the precursor to heat the use of electromagnetic radiation is preferred.

In order to increase the sensitivity of heat sensitive compositions used in the present invention it is beneficial in embodiments intended for exposure using electromagnetic radiation to include an additional component, namely a radiation absorbing compound capable of absorbing the incident electromagnetic radiation and converting it to heat (hereinafter called a "radiation absorbing compound"). It may also be desirable to include a suitable radiation-absorbing compound in embodiments intended for exposure using charged particle radiation.

In preferred compositions intended to require electromagnetic radiation for exposure, the composition may be such that it can be exposed by means of a laser under digital control. Preferably, such a laser emits radiation at above 450 nm, preferably above 500 nm, more preferably above 600 nm, and especially above 700 nm. Most preferably it emits radiation at above 800 nm. Suitably it emits radiation of wavelength below 1400 nm, preferably below 1300 nm, more preferably below 1200 nm.

Examples of lasers which can be used to expose compositions suitable for the method of the present invention include semiconductor diode lasers emitting at between 450 nm and 1400 nm, especially between 600 nm and 1200 nm. One example is the Nd YAG laser which emits at 1064 nm and another is the diode laser used in the CREO TRENDSETTER thermal image setter, which emits at 830 nm, but any laser of sufficient imaging power and whose radiation is absorbed by the composition to produce heat, can be used.

Preferably the radiation absorbing compound is one whose absorption spectrum is such that absorption is significant at the wavelength output of the radiation source, preferably laser, which is to be used in the patternwise exposure of precursors made by the method of the present invention. Usefully it may be an organic pigment or dye. It may be a black body radiation absorber, such as carbon black or graphite. It may be a commercially available pigment such as Heliogen Green as supplied by BASF or Nigrosine Base NG1 as supplied by NH Laboratories Inc or Milori Blue (C.I. Pigment Blue 27) as supplied by Aldrich. It may be a dye or pigment of the squarylium, merocyanine, phthalocyanine, cyanine, indolizine, pyrylium or metal dithioline classes.

In preferred compositions intended to require infra-red radiation for patternwise exposure it is preferred that their developer solubility is not increased by incident UV or visible radiation, thereby making handling of the compositions straightforward. Preferably such compositions do not comprise any UV or visible light sensitive components. However UV or visible light sensitive components which are not activated by UV or visible light due to the presence of other components, such as UV or visible light absorbing dyes or a UV or visible light absorbing topmost layer, may be present in such compositions.

Pigments are generally insoluble in the compositions and so comprise particles therein. Generally they are broad band absorbers, preferably able efficiently to absorb electromagnetic radiation and convert it to heat over a range of wavelengths exceeding 200 nm in width, preferably exceeding 400 nm in width. Generally they are not decomposed by the radiation. Generally they have no or insignificant effect on the solubility of the unheated composition, in the developer. In contrast dyes are generally soluble in the compositions. Generally they are narrow band absorbers, typically able efficiently to absorb electromagnetic radiation and convert it to heat only over a range of wavelengths typically not exceeding 100 nm in width, and so have to be selected having regard to the wavelength of the radiation which is to be used for imaging.

Suitably the radiation absorbing compound, when present, constitutes at least 0.25%, preferably at least 0.5%, more preferably at least 1%, most preferably at least 2%, preferably up to 25%, more preferably up to 20%, most preferably up to 15%, of the total weight of the composition. A preferred weight range for the radiation absorbing compound may be expressed as 0.25–25% of the total weight of the composition. More specifically, in the case of dyes the range may preferably be 0.25–15% of the total weight of the composition, preferably 0.5–8%, while in the case of pigments the range may preferably be 1–25%, preferably 2–15%. For pigments, 5–15% may be especially suitable. In each case the figures given are as a percentage of the total weight of the dried composition. There may be more than one radiation-absorbing compound. References herein to the proportion of such compound(s) are to their total content.

A preferred, heat sensitive, composition preferably includes a modifying means for modifying the properties of the composition. Such a modifying means is preferably arranged to alter the developer solubility of the composition compared to when the modifying means is not present in the composition. The modifying means may be covalently bonded to a polymer of the composition or may be a compound which is not covalently bonded thereto.

The modifying means may be selected from:

Functional groups as described in WO 99/01795, which is incorporated herein by reference.

Diazide moieties described in WO 99/01796, which is incorporated herein by reference.

Separate compounds, not being diazide moieties, and described in WO 97/39894, WO 99/08879 and WO 99/21725, all of which are incorporated herein by reference Examples described include nitrogen-containing compounds wherein at least one nitrogen atom is either quaternized or incorporated in a heterocyclic ring; or quaternized and incorporated in a heterocyclic ring. Examples of useful quarternized nitrogen containing compounds are triaryl methane dyes such as Crystal Violet (CI basic violet 3) and Ethyl Violet. WO 97/01796 describes lithographic printing applications and WO 99/08879 describes electronic part applications of this technology. WO 99/21725 describes improvements to this technology brought about by the use of certain developer resistance aids, notably siloxane compounds.

Latent Bronsted acids, onium salts or acid generating compounds as described in patents mentioned above, for example U.S. Pat. No. 5,491,046, U.S. Pat. No. 4,708,925 and EP 819980, all of which are incorporated herein by reference.

Preferred heat solubilizable compositions are compositions which do not contain diazide moieties.

The present invention may be applied with benefit to precursors with a wide range of compositions; but particularly to such composition for which patternwise exposure entails the delivery of radiation to selected areas of the precursor; and especially to such compositions for which delivery of radiation causes the solubility change not by irreversible chemical decomposition. In certain compositions used in the present invention, radiation imaging produces areas which have transient increased solubility in the developer. After an interval, such may partially or wholly revert to their original, non-imaged level of solubility. Thus the mode of action of such compositions does not require radiation-induced decomposition of the reversible insoluble means but, more likely, the break-up of a physico-chemical triplex, which can re-form. Consequently, in such preferred embodiments the precursor is contacted with a developer within a time period of 20 hours or less of the exposure to imaging heat, preferably within about 120 minutes of exposure, and most preferably immediately after exposure.

Certain compositions useful in the present invention may contain a reversible insolubilizer compound and, preferably, an infra-red absorbing compound; or a compound which functions as a reversible insolubilizer compound and as an infra-red absorbing compound. Examples are given in WO 97/39894, WO 99/08879 and WO 99/21725. Indeed, the compositions and precursors described in WO 97/39894, WO 99/08879 and WO 99/21725 are preferred compositions and precursors to which the present invention can be applied.

Suitably a reversible insolubilizer compound, when present (whether or not also acting as a radiation absorbing compound) constitutes at least 1%, preferably at least 2%, preferably up to 15%, more preferably up to 25% of the total weight of the composition.

An especially preferred heat-soluble composition useful in the present invention thus comprises a composition as defined above, and, additionally, either an infra-red absorbing compound to convert infra-red radiation to heat and a said reversible insolubilizer compound as described in WO 97/39894 and WO 99/08879; or an infra-red absorbing compound which converts infra-red radiation to heat and which also functions as a reversible insolubilizer compound.

Suitably the composition useful in the present invention, regardless of whether it is patternwise solubilized by heat, visible or UV radiation, additionally contains a developer resistance means as defined in WO 99/21725, suitably a siloxane, preferably constituting 1–10 wt. % of the composition. Preferred siloxanes are substituted by one or more optionally-substituted alkyl or phenyl groups, and most preferably are phenylalkylsiloxanes and dialkylsiloxanes. Preferred siloxanes have between 10 and 100 —Si(R1)(R2)O— repeat units. The siloxanes may be copolymerised with ethylene oxide and/or propylene oxide. For further information on preferred siloxanes the definitions in WO 99/21725 may be recited.

The compositions used in the invention may contain other ingredients such as stabilizing additives, inert colorants, and additional inert polymeric binders as are present in many positive working compositions.

In certain embodiments of the invention an additional layer comprising a radiation-absorbing compound can be used. This multiple layer construction can provide routes to high sensitivity as larger quantities of absorber can be used without affecting the function of the image-forming layer. In principle any radiation absorbing material which absorbs sufficiently strongly in the desired band can be incorporated or fabricated in a uniform coating. Dyes, metals and pigments (including metal oxides) may be used in the form of vapor deposited layers. Techniques for the formation and use of such films are well known in the art, for example as described in EP-A-652483, incorporated herein by reference.

In the specification when it is stated that a composition is developer soluble it is intended that the composition is soluble in a selected developer, to an extent useful in a practical development process. When it is stated that a composition is developer insoluble it is intended that the composition is not soluble in the selected developer, to an extent useful in a practical development process.

Thus in preferred embodiments a positive working pattern may be obtained after patternwise exposure and development of a precursor made by the method of the present invention. The developer solubility of the composition after it has been subjected to patternwise exposure is greater than the solubility of the corresponding unexposed composition. In preferred embodiments this solubility differential is increased by means of additional components and/or by resin modification, as described herein, and in our earlier patent applications which are referred to. Preferably such measures reduce the solubility of the composition, prior to the patternwise exposure. On subsequent patternwise exposure the exposed areas of the composition are rendered more soluble in the developer, than the unexposed areas. Therefore on patternwise exposure there is a change in the solubility differential of the unexposed composition and of the exposed composition. Thus in the exposed areas the composition is dissolved, to form the pattern.

The coated precursor produced by the method of the invention may in use be patternwise exposed indirectly by exposure to a short duration of high intensity radiation transmitted or reflected from the background areas of a graphic original located in contact with the recording material.

The developer is dependent on the nature of the polymeric substance, but is preferably an aqueous developer. Common components of aqueous developers are surfactants, chelating agents such as salts of ethylenediamine tetraacetic acid, organic solvents such as benzyl alcohol, and alkaline components such as inorganic metasilicates, organic metasilicates, hydroxides or bicarbonates.

Preferably an aqueous developer is an alkaline developer containing one or more inorganic or organic metasilicates.

According to a second aspect of the present invention there is provided a method of manufacturing an imaged member from an imaged member precursor of the first aspect of the invention, the method comprising:

(a) imagewise exposing the imaged member precursor; and (b) removing the exposed or non-exposed areas to provide image and non-image areas.

The method may include additionally treating the imaged member to further increase the dimensional stability of the paper, using a treatment comprising at least one of:

(I) coating the imaged member on a non-coated surface thereof with a chemical agent; or (II) laminating the imaged member on a non-coated surface thereof with a sheet material.

Suitable chemical agents include orthochloroaniline formaldehyde, propylene glycol (50:50), 4–4'-diaminophenyl methane, and a mixture of 20% thiophosphorin-tris-(isocyanatophenyl ester) and 80% methylene chloride or polyisocyanate in ethylene.

Suitable sheet materials for lamination to the imaged member include aluminum sheets, and plastics sheets such as epoxy, polyethylene or polyester sheets, and the like, for example. The sheet material may be laminated to the imaged member by first contacting the sheet material and/or substrate of the imaged member with an adhesive and contacting the sheet material with the imaged member.

The following examples more particularly serve to illustrate various embodiments of the present invention described hereinabove.

Materials and Equipment

The following are referred to hereinafter:

SDP Paper—SDP-RHN125 polyester and paper, 0.14 mm thick supplied by Lithosupplies, 19 Westland Road, Leeds, UK;

Dimensionally Stable paper—Hyply E, Cotton rag, 0.16 mm thick supplied by Jones and Stroud Company, Longridge, Preston, UK;

Tensometer—Hounsfield HTE tensometer supplied by Hounsfield Limited, Croydon, UK.

OYO Thermal imagesetter—Supplied by OYO Instruments Inc, Houston, Tex., US;

Sodium silicate solution—Sodium silicate having a ratio $SiO_2$:$Na_2O$ in the range 3.17 to 3.45 (average about 3.3); being a composition of 27.1 to 28.1 wt % $SiO_2$, 8.4 to 8.8 wt % $NaO_2$ with the balance being water, and the density of about 75 Twaddel, equivalent to 39.5 Baume and a specific gravity of 1.375;

Deionised water—Deionised water having a resistivity of 5 Mohm.cm;

Alumina powder—$Al_2O_3$ powder comprising alumina (99.6%) in the shape of hexagonal platelets, mean particle size of 3 microns and having a hardness of 9 Moh;

Dowfax 2A1—An anionic surfactant comprising a mixture of mono and disulfonates from Dow chemicals, Middlesex, UK;

Titanium Dioxide—Rutile titanium dioxide provided with an inorganic coating of $Al_2O_3$, XnO and $XnPO_4$, mean crystal size 0.23 micron, supplied from Tioxide, Billingham, UK;

Goldstar Developer—14% sodium metasilicate in water supplied by Kodak Polychrome Graphics, Norwalk, Conn., USA;

RO300—A dimethyl maleimide photopolymer supplied by Rohner AG, Prattelm, Switzerland;

RO301—A thioxanthone sensitizer supplied by Rohner, Switzerland;

Polydimethyl siloxane—Supplied by Aldrich, Dorset, UK;

(30–35%) methylhydro(65–70%) dimethyl siloxane copolymer—Supplied by Alrich, UK;

Platinum divinyltetramethyldisiloxane catalyst, 3% in xylene—As supplied by Alrich, UK.

EXAMPLE 1

A hydrophilic coating formulation, Formulation A was prepared as follows: Deionised water (48 g, 24 wt %), and sodium silicate solution 80 g, 40 wt %) were added to a beaker (250 ml) and the solution sheared using a Silverson high shear mixer operating at maximum speed. Titanium dioxide powder (36 g, 18 wt %) was then added in portions of 2 g every ten seconds. On completion of the addition, the liquid was sheared for a further two minutes. Then, alumina powder (36 g, 18 wt %) was added in portions of 2 g every ten seconds. On completion of the addition, the liquid was sheared for a further two minutes. Finally Dowfax 2A1 (0.18 wt %) was added with stirring. The viscosity of Formulation A was found to be about ten centipoise when measures at 20° C. and the shear rate of 200 $s^{-1}$ using a Mettler Rheomat 180 viscometer incorporating a double gap geometry.

Sheets of SDP paper or dimensionally stable Hyply E paper were coated on one face with Formulation A to give a wet film weight of about 8 $gm^{-2}$ and oven dried at 130° C. for 80 seconds to produce a hydrophilic layer on the paper sheets. The sheets were then post treated by immersion in aluminum sulphate (0.1M) for thirty seconds, followed by spray rinsing with tap water and drying under a fan.

Printing plates were produced from the dimensionally stable Hyply E and SDP paper supports by coating, using a wire wound rod or bar, an ARIES (trade mark) light sensitive composition comprising quinone diazide and novolak resin as supplied by Kodak Polychrome Graphics, Norwalk, Conn., USA, at a dry coating weight of 2 $gm^{-2}$, over the hydrophilic layer. The light sensitive coating was dried at 130° C. for 80 seconds.

The printing plates were exposed through a mask according to standard procedures and developed by immersion in Goldstar developer for 60 seconds. In both cases, the area of the coating struck by radiation dissolved away in the developer, leaving an accurate copy of the mask image. The printing plates comprising the dimensionally stable Hyply E support were run on a Heidelberg Speedmaster 52 printing press. The press was stopped after 10,000 impressions and the plate found to be generally unworn after inspection.

The mechanical properties of areas from which imageable material had been removed of the dimensionally stable Hyply E plates and SDP Paper plates with hydrophilic Formulation A coating were evaluated using a Hounsfield tensometer set up with the following values:

Force: 20% range

Extension range: 50 mm

Speed: 0.5 mm per minute

Mechanical properties determined were the tensile force required to exceed the elastic yield of the printing plate, the percentage elongate of the elastic yield and the Young's Modulus under tensile load. The sheets tested were cut to a standard template shape, of rectangular cross section.

The template was attached to the tensometer by clamping the leading and trailing edges of the template in the jaws of the tensometer and the suitable load connected to provide stress on the template. The three characteristics were displayed electronically using the tensometer.

The results of the testing are provided in Table 1.

TABLE 1

| Property of the Material | SDP Paper | Hyply E |
|---|---|---|
| Elastic yield force (N) | 60 | 125 |
| Elongation of elastic yield (%) | 1 | 0.15 |
| Inelastic yield force | 75 | 175 |
| Young's Modulus (GPa) | 7 | 15 |

The results show that Hyply E paper printing plates comprising hydrophilic layer on which is mounted in an imageable coating were more dimensionally stable than SDP paper printing plates, and provided good wear resistance after 10,000 impressions effected through running through a printing press.

EXAMPLE 2

Hyply E dimensionally stable paper sheeting was coated directly with a waterless imageable layer comprising:

0.48 g RO300

0.08 g RO301

0.106 g Polydimethyl siloxane (vinyl dimethyl terminated)

0.054 g (30–35%) methylhydro (65–70%) dimethyl siloxane copolymer 1 drop of platinum divinyltetramethyldisiloxane catalyst, 3% in xylene 2.88 g methylethyl ketone The coated sheets were allowed to dry and the resultant plates exposed through a positive film using a Montakop lightframe, baked at 130° C. for 3 minutes using a developer Z (a water solution of 4.8% sodium diisopropyl naphthalene sulfonate, 3.6% benzyl alcohol, 2.15% sodium sulfite, 1.7% trisodium citrate) at 20° C. for 60 seconds. The area of the coating not struck by radiation dissolved away in the developer, leaving an accurate copy of the mask image. The thus formed positive printing plate was inked up and used on a printing press as a waterless plate requiring no fount solution. The ink was accepted by the revealed Hyply E support. The remaining photosensitive coating, rejected ink. Several hundred good prints were obtained with good resolution.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extend to any novel one, or any novel combination, of the features disclosed in this specification (including any accompanying claims, abstract and drawings), or to any novel one, or any novel combination, of the steps of any method or process so disclosed.

What is claimed is:

1. A precursor to an imaged member comprising:

(i) a dimensionally stable substrate, wherein the uncoated dimensionally stable substrate includes dimensionally stable paper having less than 0.25 percentage elongation under a tensile load or strain at the inelastic yield point of the paper;

(ii) hydrophilic coating coated on the dimensionally stable substrate; and (iii) an imageable coating coated on the hydrophilic coating.

2. The precursor to an imaged member as claimed in claim 1, wherein the dimensionally stable substrate further comprises dimensionally stable paper having a Young's Modulus under tensile load greater than 7 GPa.

3. The precursor as claimed in claim 2, wherein the Young's Modulus of the paper under tensile load is greater than 10 GPa.

4. The precursor to an imaged member as claimed in claim 1, wherein the dimensionally stable substrate further comprises dimensionally stable paper having an inelastic yield such that the tensile force required to exceed the inelastic yield of the paper is greater than 75 $Nmm^{-2}$.

5. The precursor as claimed in claim 1, wherein the paper comprises natural or synthetic fibers.

6. The precursor as claimed in claim 5, wherein the paper comprises cotton, cellulosic material, polyester, polyethylene fibers or mixtures thereof.

7. The precursor as claimed in claim 1, wherein the paper comprises strengthening fibers.

8. The precursor as claimed in claim 7, wherein the strengthening fibers comprise silicon fibers, cellulose fibers or graphite fibers, in addition to the regular fibers of the paper material.

9. The precursor as claimed in claim 1, wherein the precursor is a precursor to a printing form or a precursor to an electronic part.

10. The precursor as claimed in claim 1, wherein the imageable coating comprises a positive working composition or a negative working composition.

11. The precursor as claimed in claim 1, wherein the imageable coating is selected from the group consisting of a diazo coating, photopolymer coating, silver halide coating, electrophotographic coating, thermally sensitive coating, ablatable coating and a waterless printing coating.

12. The precursor as claimed in claim 1, wherein the imageable coating is image-wise exposable by radiation such that the imageable coating is insolubilized or solubilized by the radiation.

13. The precursor as claimed in claim 12, wherein the radiation is selected from the group consisting of visible radiation, UV radiation, and a combination thereof.

14. The precursor as claimed in claim 13, wherein the radiation is of a wavelength between 300 nm and 450 nm.

15. The precursor as claimed in claim 1, wherein the imageable coating is image-wise exposable by heat such that the imageable coating is insolubilized or solubilized by the heat.

16. The precursor as claimed in claim 1, wherein the imageable coating contains a developer resistance means.

17. The precursor as claimed in claim 16, wherein the developer resistance means is a siloxane.

18. The precursor as claimed in claim 1, wherein the hydrophilic coating comprises deionised water and sodium silicate.

19. The precursor as claimed in claim 18, wherein the hydrophilic coating further comprises titanium dioxide powder and alumina powder.

20. A method of manufacturing an imaged member comprising:

(a) providing a precursor to an imaged member having (i) a dimensionally stable substrate, wherein the uncoated dimensionally stable substrate includes dimensionally stable paper having less than 0.25 a percentage elongation under a tensile load or strain at the inelastic yield point of the paper (ii) a hydrophilic coating coated on the dimensionally stable substrate; and (iii) an imageable coating coated on the hydrophilic coating;

(b) imagewise exposing the precursor to an imaged member to provide an imaged member; and (c) removing the exposed or non-exposed areas to provide image and non-image areas.

21. The method as claimed in claim 20, further comprising:

(d) treating the imaged member to further increase the dimensional stability of the paper wherein the treatment includes coating the imaged member on a non-coated surface thereof with a chemical agent.

22. The method as claimed in claim 21, wherein the chemical agent is orthocholoraniline, propylene glycol (50:50), 4-4'-diaminophenyl methane or a mixture of thiophosphorin-tris-(isocyanatophenyl ester) and methylene chloride or polyisocyanate in ethylene.

23. A precursor to an imaged member comprising:

(i) a dimensionally stable substrate, wherein the uncoated dimensionally stable substrate includes dimensionally stable paper having less than 0.25 percentage elongation under a tensile load or strain at the inelastic yield point of the paper;

an inelastic yield such that the tensile force required to exceed the inelastic yield point of the paper is greater than 75 $Nmm^{-2}$;

a Young's Modulus under tensile load greater than 7 GPa; and (ii) a hydrophilic coating coated on the dimensionally stable substrate; and (iii) an imageable coating coating coated on the hydrophilic coating.

* * * * *